United States Patent [19]

Noggle

[11] Patent Number: 4,738,643

[45] Date of Patent: Apr. 19, 1988

[54] BOW FACING ROWING APPARATUS

[76] Inventor: Joseph H. Noggle, P.O. Box 503 Sudden Valley, Bellingham, Wash. 98226

[21] Appl. No.: 852,977

[22] Filed: Apr. 16, 1986

[51] Int. Cl.[4] ..... B63H 16/10

[52] U.S. Cl. ..... 440/103

[58] Field of Search ..... 440/102, 103, 104, 105; 416/69, 70 R, 72, 74; 74/416, 417, 423

[56] References Cited

U.S. PATENT DOCUMENTS

| | | | |
|---|---|---|---|
| 522,545 | 7/1894 | Wright | 440/103 |
| 1,540,695 | 6/1925 | Howard | 440/103 |
| 1,909,359 | 5/1933 | Jaeger | 440/103 |
| 2,869,385 | 1/1959 | Geyer | 74/423 X |

*Primary Examiner*—Sherman D. Basinger

*Attorney, Agent, or Firm*—Hughes, Cassidy & Multer

[57] ABSTRACT

Rowing apparatus for propelling an oar driven watercraft in a direction in which the oarsman is facing. The apparatus includes a handle portion, a blade portion, and a transmission mechanism interconnecting the handle and blade portions. Through the transmission mechanism, rearward movement of the handle portion causes corresponding rearward movement of the blade portion to propel the watercraft in the forward direction. Likewise forward movement of the handle portion, as during the stroke recovery, causes corresponding forward movement of the blade portion. Rotation of the handle portion about its longitudinal axis is transmitted via the transmission mechanism to cause a corresponding rotation of the blade portion so that the blade may be axially rotated.

10 Claims, 5 Drawing Sheets

FIG. 3
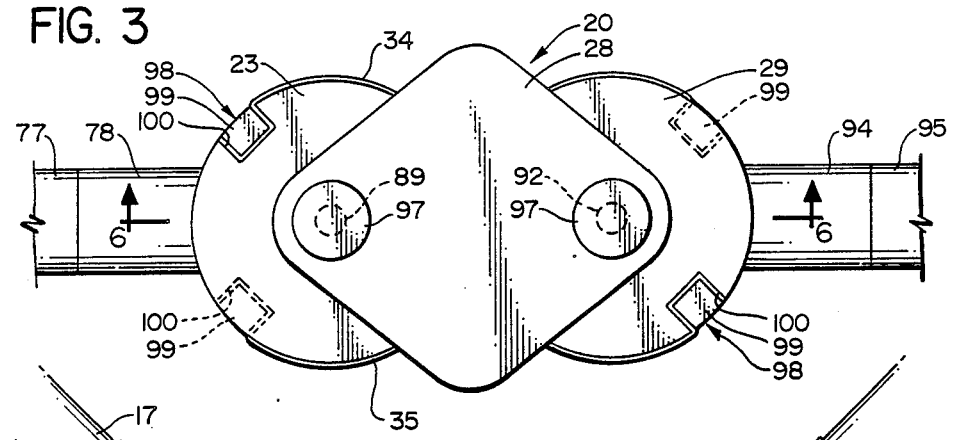
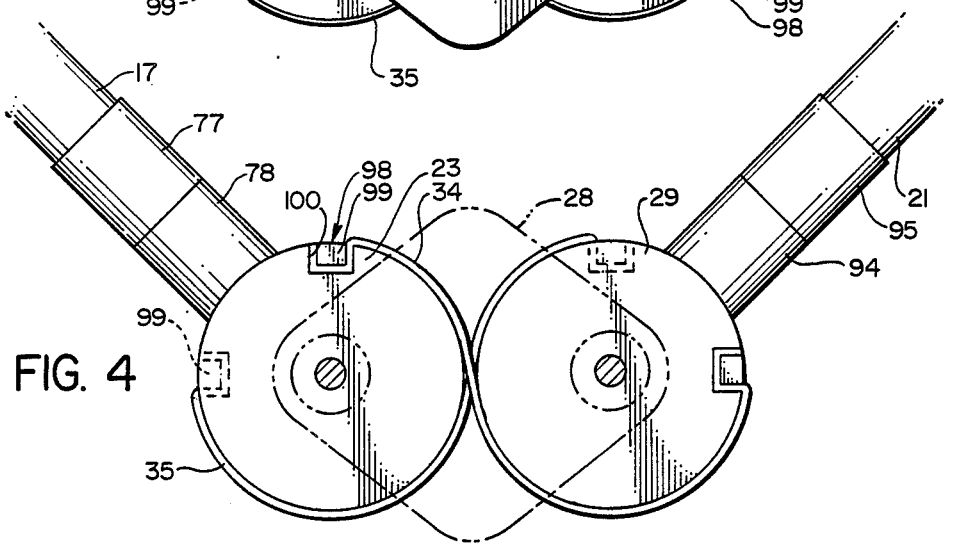
FIG. 4
FIG. 5
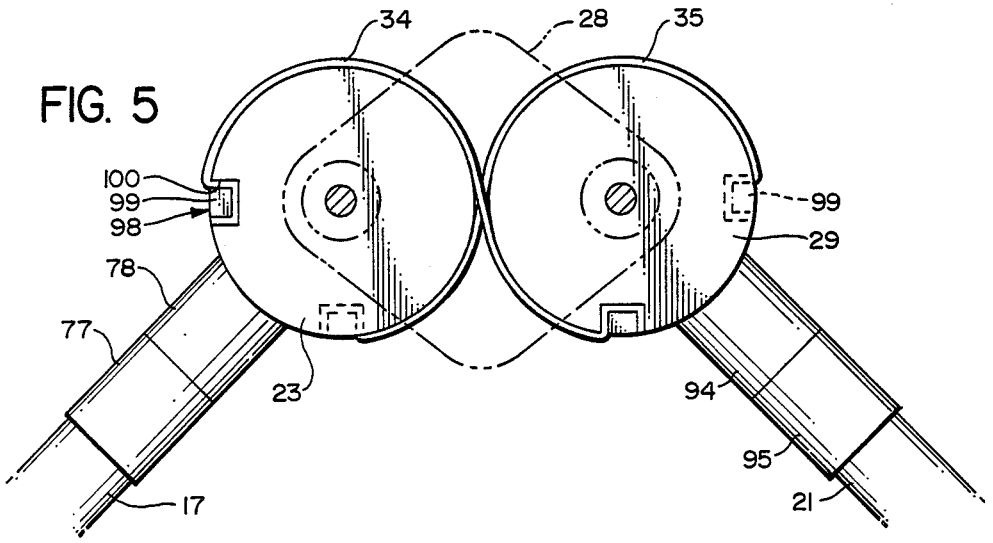

BOW FACING ROWING APPARATUS

TECHNICAL FIELD

The present invention relates to apparatus for transmitting a rowing stroke from an oar handle to an oar blade in a manner that a boat is propelled in a direction in which the oarsman is facing, and for axially rotating the oar blade in correspondence with an axial rotation of the oar handle by the oarsman during the rowing stroke or recovery therefrom.

BACKGROUND OF THE INVENTION

Efficient propulsion of watercraft by means of one or more sets of oars requires manipulation of the blade portion of the oar so that a maximum amount of thrust is generated when the blade is in the water, and a minimum amount of drag results when the blade leaves the water. This is particularly true in competitive rowing which utilizes a stroke and recovery method which is designed to produce optimum thrust and minimum drag. As the blade is propelled through the water by the stroke of the oarsman, the blade is maintained at an angle generally perpendicular to the surface of the water. In preparation for the recovery, where the blade travels forward out of the water, the blade is rotated or feathered to occupy a position where it is generally parallel to the surface of the water. This feathering is achieved by rotating the blade to a horizontal location by rotation of the wrist as the blade is raised clear of the water. After completion of the recovery and in preparation for entry of the blade back into the water, the blade is again rotated or squared so that it occupies a vertical position.

In order to permit an oarsman to face the direction in which the boat is traveling, conventional apparatus have been disclosed for connecting an oar handle to an oar blade so that as the handle is moved in a longitudinal direction, such as for example, in a rearward direction, the is blade moved in the corresponding direction. Likewise, if the handle is moved in a forward direction, the blade is caused to move in the corresponding forward direction. These apparatus typically include a pair of adjacent drum members, one of which is connected to the oar handle, and the other of which is connected to the oar blade. These drums are typically mounted upon the gunwhale of a boat, and are interconnected by belts, chains, straps, or the like. These driving belts form an S-like configuration when the belts are typically mounted one above the other, and attached at their opposite ends to the respective drums. The belts are connected to the drums in a manner that a driving force from the oar handle is transmitted to its associated drum which in turn transmits a rotating driving force to the adjacent drum thereby moving the oar blade in a corresponding forward or rearward direction. Conventional oar transmission members of this configuration are disclosed in U.S. patents such as U.S. Pat. No. 107,669 by Dann; U.S. Pat. No. 195,778 by Wall; U.S. Pat. No. 284,984 by Schunk; U.S. Pat. No. 494,948 by Boardman; U.S. Pat. No. 538,081 by McFarland; U.S. Pat. No. 691,080 by Shedd; U.S. Pat. No. 788,884 by Buff; U.S. Pat. No. 808,720 by Buff; and U.S. Pat. No. 2,466,351 by Ankarlo.

Although the above-identified patents disclose transmission mechanisms for allowing a boat to be propelled by one or more oars in a forward facing direction, none of the patents disclose mechanisms to permit the oars to be feathered and/or squared as discussed previously.

In U.S. Pat. No. 1,034,462 by Johnson, there is disclosed a bow facing oar having a handle portion joined to a paddle portion by a universal joint. When the oar is used for a propulsion stroke, the rearward movement of the handle causes a corresponding movement of the oar blade. The universal joint allows the oar blade to be feathered or squared in correspondence with a rotation of the oar handle.

SUMMARY OF THE INVENTION

The present invention pertains to a rowing apparatus for propelling an oar driven watercraft in a direction in which the oarsman is facing. The apparatus includes a handle portion having an elongated shaft, a blade portion having an elongated shaft, and a mechanism (i) for transmitting a fore and aft movement of the handle portion to the blade portion to cause corresponding fore and aft movement of the blade portion, and (ii) for transmitting axial rotation of the handle portion to the blade portion to feather or square the blade portion.

In order to accomplish these functions, the transmission mechanism includes a pair of adjacent cylindrical actuating drums which are rotatably mounted within a housing which in turn is connected to the gunwhales or outriggers of the watercraft. These actuating drums are interconnected by means of upper and lower straps or cables, each of which is engaged about the actuating drums in opposing S-shaped configurations. Thus, a rearward pull on the handle portion causes a counterclockwise rotation of the associated drum which is transmitted via the upper belt to generate a clockwise rotation of the other drum and a corresponding rearward movement of the blade portion. Likewise, forward movement of the handle portion is transmitted via the drums and lower strap to cause a corresponding forward movement of the blade portion.

In order to generate an axial rotation of the blade portion which corresponds to the axial rotation of the handle portion, the handle portion includes a shaft extending through the housing which in turn drives an intermediate shaft supported within the housing. The intermediate shaft is in turn engaged to a shaft which is connected to the blade portion. The handle portion shaft, and blade portion shaft are engaged to opposite ends of the intermediate shaft by means of bevel gears fixed to the handle portion, blade portion and intermediate shaft, respectively, as well as by respective idler gears engaged between opposing bevel gears of the blade portion shaft and intermediate shaft, and the intermediate shaft and handle portion shaft. This allows the blade portion to be axially rotated in a selected magnitude and direction.

It is therefore an object of the present invention to provide apparatus for rowing a watercraft in which the oarsman faces the direction in which the watercraft is propelled.

It is a further object of the present invention to provide a rowing apparatus which causes movement of the blade portion of an oar in the same longitudinal direction as the handle portion of the oar.

Another object of the present invention is to provide a rowing apparatus wherein axial rotation of the handle portion provides a corresponding axial rotation of the blade portion.

BRIEF DESCRIPTION OF THE DRAWINGS

These and other objects and advantages of the present invention will become more readily apparent upon reading the following Detailed Description and upon reference to the attached Drawings in which:

FIG. 3 is a plan view of the transmission mechanical where the blade and handle portions are in midstroke;

FIG. 4 is a plan view of the transmission mechanism showing a pair of actuating drums in solid lines and a housing in phantom whereby the handle and blade portions of the oars are positioned in preparation for a propelling stroke;

FIG. 5 is a plan view similar to FIG. 4 except that the handle and blade portions of the oar are in position after completion of a propelling stroke;

Figure 1:
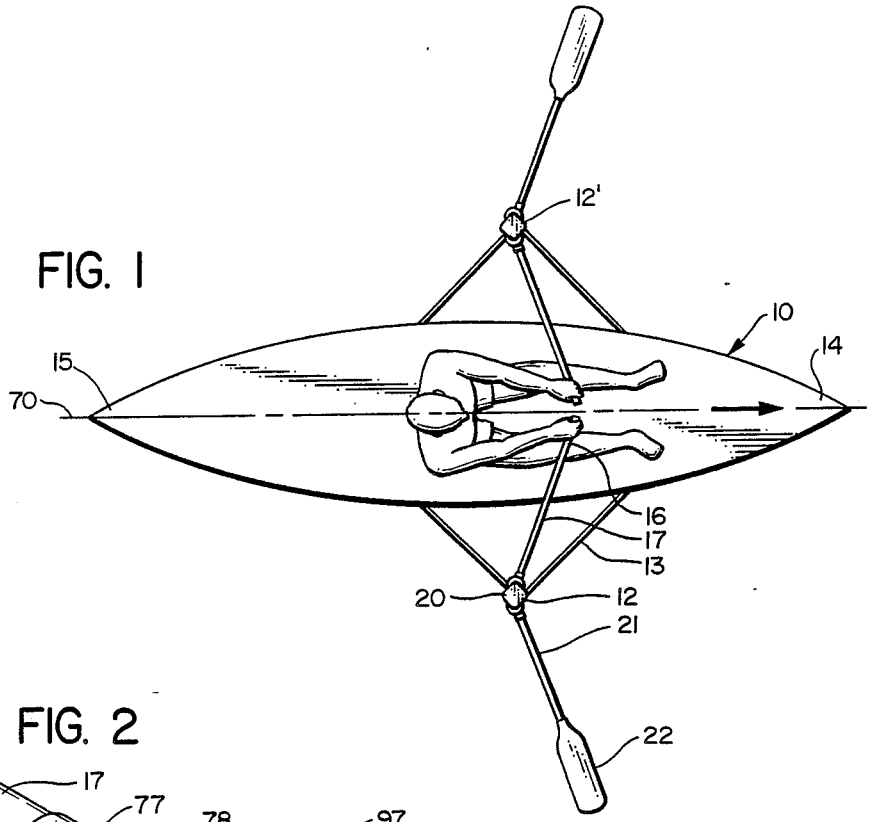
FIG. 1 is an overhead view of a boat being rowed by an oarsman utilizing the apparatus of the present invention.

While the present invention is susceptible to various modifications and alternative forms, specific embodiments thereof have been shown by way of example in the Drawings and will herein be described in detail. It should be understood, however, that it is not intended to limit the invention to the particular forms disclosed, but on the contrarY the intention is to cover all modifications, equivalents, and alternatives falling within the spirit and scope of the invention.

DETAILED DESCRIPTION OF THE INVENTION

The present invention pertains to a rowing apparatus which is adapted to be fitted to watercraft, typically a rowboat. The rowing apparatus of the present invention permits the person doing the rowing, hereinafter "oarsman", to face the direction in which the boat is propelled. Furthermore, the rowing apparatus of the present invention permits the oar blades to be axially rotated by a corresponding rotation of the oar handles.

To provide a better understanding of the present invention, the principal elements will be described first, followed by a more detailed discussion of these and other elements of the invention.

Referring to FIG. 1, there is shown a boat 10 having starboard and port rowing apparatus, generally indicated at 12, 12', respectively, and which are attached to boat 10 at outrigger 13. For ease of discussion only the starboard rowing apparatus 12 will be described herein, however, it should be appreciated that both rowing apparatus are essentially identical. Boat 10 includes a bow 14 towards which the oarsman faces and which is defined hereinafter as the "forward" direction, as well as a stern 15 which occupies a location "rearward" of bow 14.

Figure 2:
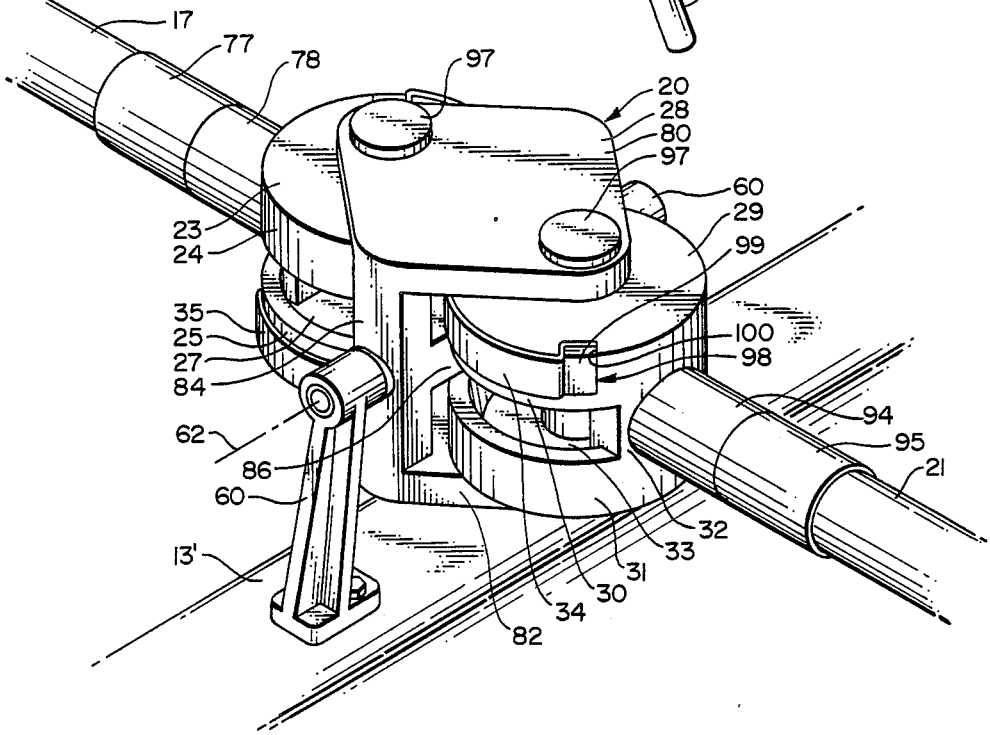
FIG. 2 is an isometric view of the transmission mechanism of the present invention.

As shown in FIGS. 1 and 2, rowing apparatus 12 includes a handle portion 16 having a shaft 17 which is connected via transmission means indicated at 20 to a shaft 21 having a blade portion 22. Handle portion 16 is connected to an actuating drum 23 having cylindrical upper and lower horizontal flanged portions 24, 25 which are oined by a vertical portion 26 (FIG. 6) and which is open at its right end to form a mouth portion 27. Actuating drum 23 in turn is pivotally mounted within a housing 28. Likewise, transmission means 20 includes an actuating drum 29 having cylindrical upper and lower horizontal flanged portions 30, 31 which are joined by a vertical portion 32 and which is open at its left end to form a mouth portion 33. Actuating drum 29 has a radius at its respective upper, lower flanged portions 30,31 which is substantially equal to the radius of flanged portions 24, 25 of drum 23. Drum 29 is pivotally mounted within housing 28 at a location somewhat adjacent to actuating drum 23 and is operatively connected to blade shaft 21.

In order that blade 22 move in a longitudinal direction corresponding to the longitudinal direction of movement of handle 16, and so as to propel the boat 10 in the direction in which the oarsman is facing, actuating drums 23, 29 are interconnected by connecting means 34, 35, which in an exemplary embodiment, include elongated flexible straps as shown more clearly in FIGS. 4 and 5. In operation, when handle 16 is pulled from a stroke preparatory position shown in FIG. 4, rearward to a stroke completion position shown in FIG. 5, the resulting counterclockwise rotation of actuating drum 23 causes a clockwise rotation via strap 34 of actuating drum 29, which in turn causes the rearward movement of blade 22 through the water. This rearward movement of blade 22 corresponds to the rearward movement of handle 16 and causes boat 10 to move in the forward direction. Similarly, when handle 16 is moved forward from the stroke completion position to the stroke preparatory position, the clockwise rotation of actuating drum 23 therewith causes a counterclockwise rotation of actuating drum 29 via strap 35 so that blade 22 is moved in a forward direction above the water which corresponds to forward movement of handle 16.

In combination with the transmission of fore and aft longitudinal movement from handle 16 to blade 22, transmission means 20 also includes a blade rotation feature which allows the blade 22 to be rotated about its axis in correspondence with the rotation of the handle 16 during the aforementioned longitudinal movement of the handle 16 and blade 22. The mechanism for transmitting the rotation of handle 16 to blade 22 is shown more clearly in FIGS. 6 and 7, and includes at the left end a handle transmission shaft 38 which is rotatably engaged within actuating drum 23 to an intermediate shaft 40 by means of opposing bevel gears 42, 44 and and intermediate idler gear 46. Similarly, intermediate shaft 40 is rotatably engaged within housing 28 and is engaged at its right end to handle end transmission shaft 50 by opposing bevel gears 52, 54 and an intermediate idler gear 56. Shafts 38, 40 and 50 have a common axis of rotation designated by a line 57 in FIG. 6. Thus, axial rotation of handle 16, causes a corresponding rotation of handle end shaft 38, an opposing rotation of intermediate shaft 40, and a rotation of blade end shaft 50 and blade 22, in the said direction and magnitude as the rotation of handle 16, thereby achieving the desired blade rotation.

It should be appreciated that during pivotal movement of actuating drum 23 (FIG. 7), if there is no axial rotation of handle 16, the positions of bevel gear 42 and idler gear 46 remain fixed relative to each other. The resulting rotation of idler gear 46 causes intermediate shaft 40 to rotate about its axis 57 in a manner to smoothly engage idler gear 56 which is rotated about its axis during stroke and recovered by the rotation of actuating drum 29 and blade end shaft 56 therewith. However, if handle 16 is rotated about its axis, the resulting rotation of handle shaft 38 and bevel gear 42 is transmitted via intermediate shaft 40 to cause a corresponding axial rotation of blade end shaft 50 and blade 22.

Referring now to the drawings in more detail, in FIG. 1 there is shown an exemplary embodiment of the present invention where transmission means 20 is connected to outrigger 13 which in turn is formed by a pair of elongated members which extend outboard from either side of boat 10 and which form a V-shaped configuration. As shown in another exemplary embodiment (FIG. 2), housing 28 is pivotally connected to a gunwhale 13' by means of vertical struts 60 which are bolted to the gunwhale 13' at their lower ends. The upper ends of struts 60 are pivotally connected to the housing 28 to permit movement of housing 28 about a pivot axis designated by a line 62 which is generally parallel to a longitudinal centerline, designated by a line 70 in FIG. 1, of boat 10. This permits blade 22 to be raised and lowered into and out of the water.

Figure 6:
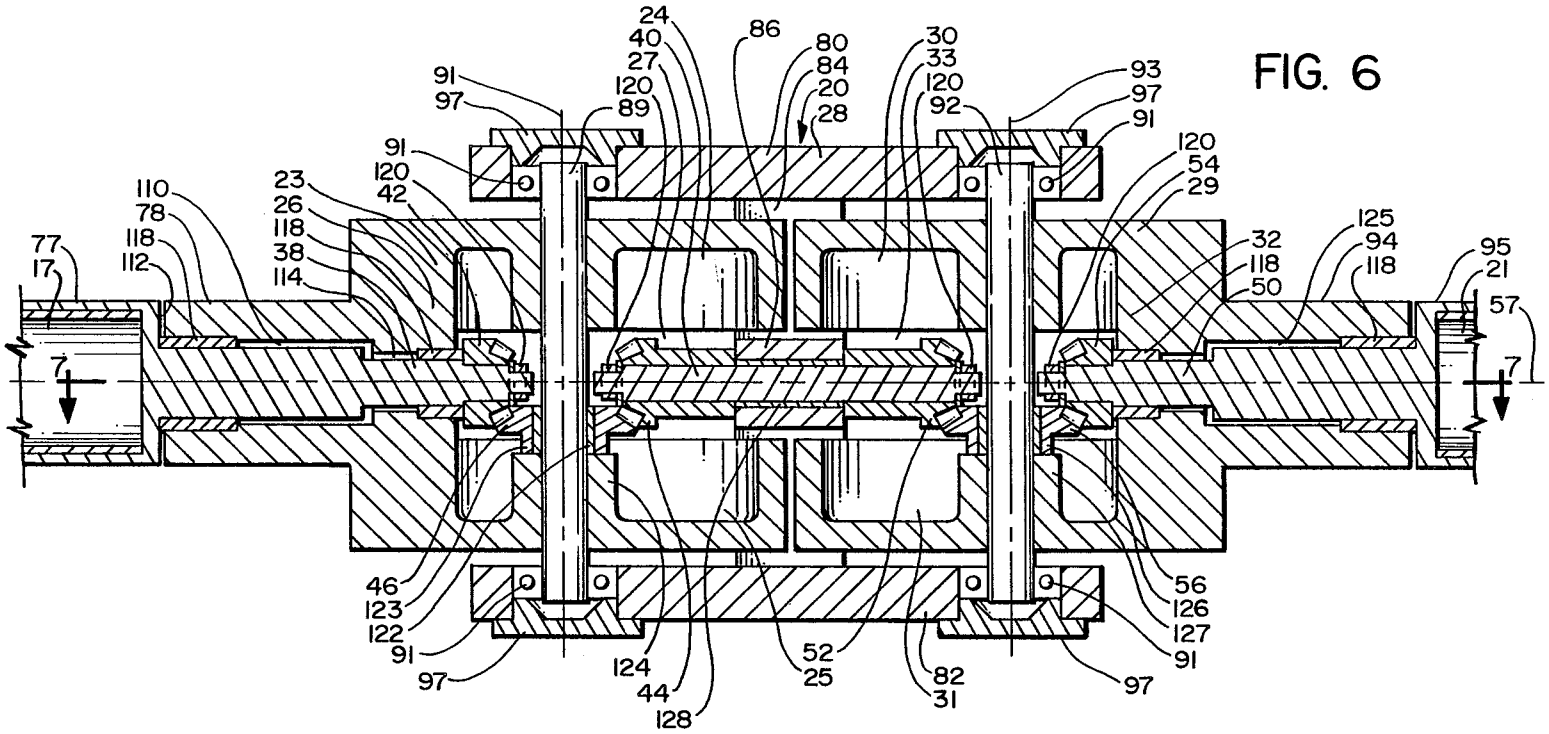
FIG. 6 is a side sectional view of the transmission mechanism taken along lines 6—6 of FIG. 3.

As shown in FIG. 2 and 6, handle 16 included shaft 17 which is engaged within a handle collar 77 which in turn is integrally connected to handle end transmission shaft 38. Transmission shaft 38 is rotatably engaged within a sleeve 78 which is co-axial with rotational axis 57 and which in turn is integrally connected to handle actuating drum 23. Actuating drum 23 is rotatably mounted to housing 28 which includes an upper horizontal flange member 80 (FIG. 1), a lower horizontal flange member 82 and which are integrally joined by vertical supports 84. Extending between vertical supports 84 and integrally connected thereto is an elongated intermediate rib flange 86 (FIG. 2) which is located parallel to upper, lower flanges 80, 82 approximately midway therebetween.

In order to permit pivotal movement, handle actuating drum 23 is rigidly connected to a vertical shaft 89 (FIG. 6) along an axial centerline of drum 23 designated by a line 90 which is generally parallel to vertical supports 84 of housing 28. Shaft 89 is pivotally mounted within vertical openings of upper, lower flanges 80, 82 by upper, lower bearings 91. Likewise, blade actuating drum 29 is mounted between upper, lower flanges 80, 82 somewhat adjacent to handle actuating drum 23 by a shaft 92 which is pivotally mounted at its upper, lower ends within vertical openings of upper, lower flanges 80, 82 by upper, lower bearings 91. Shaft 92 is rigidly mounted to actuating drum 29 by a set screw (not shown) along a vertical pivot axis, designated by a line 93, which is generally parallel to pivot axis 90. Each vertical opening is covered by a corresponding cap 97, a portion of which is frictionally engaged inside the vertical openings of flanges 80, 82. Integrally joined to blade actuating cylindier and extending co-axially with rotational axis 57, is a sleeve portion 94 which engages blade end transmission shaft 50 therein. Transmission shaft 50 includes an integral collar 95 located outside of sleeve 94 to which blade shaft 21 is rigidly connected.

As mentioned previously, rearward movement of handle 16 causes counterclockwise rotation of actuating drum 23 about pivot axis 90 which in turn is transmitted to actuating drum 29 by connecting means 34. In the present embodiment, connecting means 34 (FIGS. 4 and 5) includes a flexible, elongated strap which is attached around the outer circumferential surface of actuating drum 23 near its upper edge by a fastener indicated at 98. Strap 34 is engaged about the outer surface of actuating cylinder 23 beginning at about the eleven o'clock position in FIG. 3. In order to interconnect drums 23 and 29, strap 34 extends clockwise around the outer surface of drum 33 to about the three o'clock position. From there it extends across to actuating drum 29, and around the circumferential surface of drum 29 where it is attached to drum 29 by fastener 98 at about the five o'clock position as shown in FIG. 3. A rearward pull on handle 16 from the stroke beginning position shown in FIG. 4 to the stroke terminating position shown in FIG. 5, generates a counterclockwise rotation of actuating cylinder 23 and a clockwise rotation of actuating drum 29 via connecting strap 34, and a corresponding rearward motion of blade 22.

To generate a forward movement of blade 18 such as during recovery, connecting means 35, which is a flexible elongated strap, is connected by fastener 98 to the lower portion of handle actuating drum 23 at about the seven o'clock position as shown in FIG. 3. Connecting strap 35 wraps around the outer circumferential surface of actuating drum 23 in a counterclockwise direction, extends between drums 23 and 29, and about the outer circumferential surface of actuating drum 29 in a clockwise direction where it is attached by fastener 98 to actuating drum 29 at about the two o'clock position. Thus, clockwise rotation of actuating cylinder 23, generated by forward movement of handle 16, generates a counterclockwise rotation of actuating drum 29 via connecting strap 34.

As shown in FIGS. 2 through 5, each fastener 98 includes a square plug 99 which is frictionally engaged in a complementary shaped notch 100 in the surfaces of the actuating drums 23, 29 in order to secure the flexible connecting straps 34, 35 therein.

Figure 8:
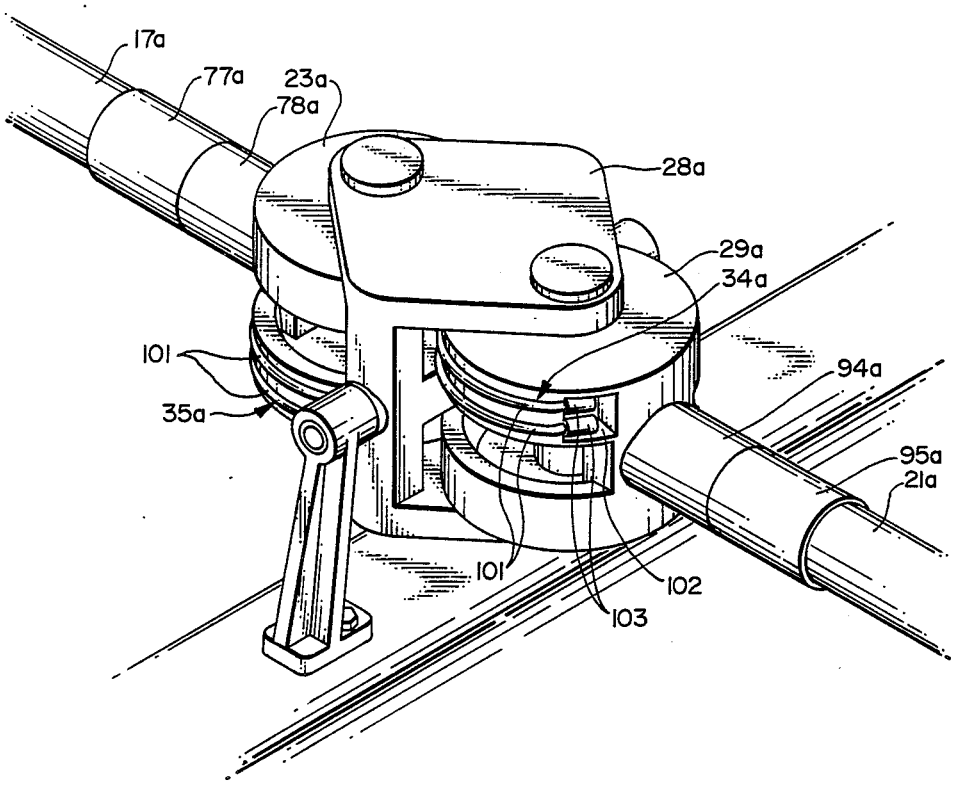
FIG. 8 is an isometric view of the transmission mechanism illustrating an exemplary embodiment where the actuating drums are interconnected by a pair of flexible cables.

In another embodiment of the present invention shown in FIG. 8, wherein like members shown in the previous embodiment are designated by like numerals with the suffix "a" attached, actuating drums *23a, 29a* are interconnected by connecting means *34a, 35a*, each of which includes a pair of flexible cables 101. The flexible cables 101 are engaged about drums *23a, 29a* within circumferential grooves (not shown) located in the surface of drums *23a, 29a*. Flexible cables 101 are secured at the opposite ends within openings 102 in the sidewalls of drums *23a, 29a* by fasteners 103.

Returning to FIG. 6, in order to receive handle end transmission shaft 38, actuating drum 23 includes a horizontally extending passageway 110 having a handle end opening 112 and a right end opening 114 which is in communication with mouth portion 27. Handle end shaft 38 is supported within passageway 110 by right, left support bearings 118. Rigidly secured to the right end of handle end transmission shaft 38 by means of a fastener 120 for rotation in a vertical plane is bevel gear 42. Fastener 120 includes a washer and threaded nut so that bevel gear 42 rotates together with transmission shaft 38 about pivot axis 57. Bevel gear 42 is engaged to intermediate shaft 40 by means of an idler gear 46 which is mounted on bearings 122 for rotation about pivot shaft 89 in a plane generally perpendicular to the rotational plane of bevel gear 42. Idler gear 46 includes a downwardly depending hub portion 123 which is supported on the lower surface of an upstanding portion 124 of mouth 27. Idler gear 46 in turn, engages and drives bevel gear 44 which includes a hub 124, the end of which engages the rib flange 80. Bevel gear 44 rotates in a vertical plane and is rigidly mounted by a fastener 120 to the handle end of intermediate transmission shaft 40. Intermediate shaft 44 includes bevel gear 52 at its blade end which is rigidly mounted to intermediate shaft 40 by a fastener 120 for rotation with shaft 40 about pivot axis 57 in a vertical plane.

In order to receive handle end transmission shaft 50, actuating drum 29 includes a horizontal passageway 125. Transmission shaft 50 is supported within passageway 125 by left, right bearings 118. Rotation of bevel gear 52 drives idler gear 56, which is rotatably engaged about pivot shaft 92. Idler gear 56 includes a hub portion 126 which is supported on the lower surface of an upstanding portion 127 of mouth 33 for rotation through a horizontal plane which is generally perpendicular to the plane of rotation of bevel gear 52. Idler gear 56, in turn is engaged to and drives bevel gear 54 which is rigidly mounted for rotation in a vertical plane to the handle end of shaft 50 by a fastener 120.

Figure 7:
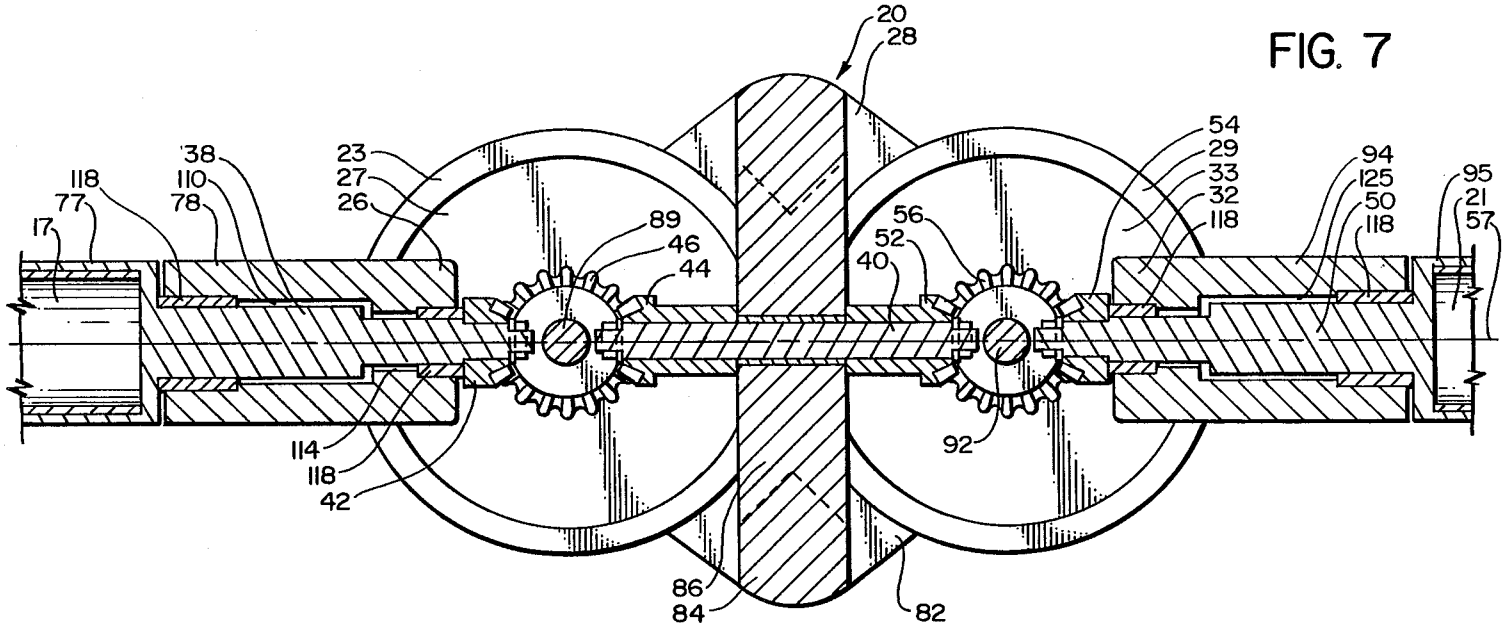
FIG. 7 is a top sectional view of the transmission mechanism taken along lines 7—7 of FIG. 6.

Referring to FIG. 7, intermediate transmission shaft 40 includes a middle portion which is supported by housing 28 within intermediate rib flange 86. Rib flange 86 has a horizontal passageway which extends along rotational axis 57 and which includes a sleeve 128 surrounding shaft 40 to permit rotation of shaft 40 about axis 57.

As further shown in FIG. 7, in order to permit rotation of actuating drum 23 about pivot shaft 89 through 180° of travel, actuating drum 23 includes mouth portion 27 which is in communication with right end opening 114 of passageway 110. Mouth portion 27 is formed by a lower horizontal surface, a rear vertical surface and an upper, horizontal surface. Mouth portion 27 extends around approximately 330° of the circumference of actuating drum 23 between opposite sides of sleeve 78. This provides sufficient clearance for rotation of actuating drum 23 about pivot shaft 89 through an arc of approximately 180°.

Similarly, actuating drum 29 includes mouth portion 33 which is in communication with a left end opening of passageway 124 and which is formed by a horizontal lower surface, a vertical surface, and a horizontal upper surface. Mouth portion 33 extends around approximately 330° of the circumference of actuating drum 29 between opposing sides of sleeve 94. This provides sufficient clearance for rotational movement of actuating drum 29 through an arc of about 180°. Thus, handle 16 and blade 22 can be moved from a forward position where they are generally parallel to boat longitudinal axis 74 and where they point in the forward direction, to a rearward position where handle 16 and blade 22 are generally parallel to longitudinal axis 74 where the point in the rearward direction.

As discussed previously, if handle 16 is held fixed by the oarsman about rotational axis 57 (FIG. 7) during the stroke, for example, and actuating drum 23 is pivoted about its axis by a discrete amount by rearward movement of handle 16, the positions of bevel gear 42 and idler gear 46 remain relative to each other with idler gear 46 rotating in the counterclockwise direction. The conterclockwise pivoting of actuating drum 23 about pivot shaft 92 during the rearward stroke is transmitted via connecting means 34 to actuating drum 29 and causes blade end transmission shaft 50 to pivot idler gear 56 in a clockwise direction through a corresponding amount. This clockwise rotation of idler gear 56 is equal in magnitude and direction to the clockwise rotation of actuating drum 29, so that is no rotation of bevel gear 54 about axis 57, and the position of blade 22 about rotational axis 57 does not change.

On the other hand, in the event handle 16 is rotated about axis 57, for example, during the aforementioned rearward stroke, idler gear 46 is rotated about axis 57 by an amount equal to the sum of the rotational amount of drum 23 and handle 16, as is intermediate transmission shaft 40. This is turn causes rotation of idler gear 56 by the same amount. However, actuating drum 29 is only pivoted about shaft 92 by an amount equal to the rotation of drum 23, thus resulting in blade end transmission shaft 50 and blade 22 being rotated about axis 57 by an amount equal to the rotation of handle 16.

What is claimed is:

1. A rowing apparatus adapted for use by an oarsman to propel a watercraft, having a forward to rearward longitudinal axis, in a direction which corresponds to a direction in which the oarsman faces, the rowing apparatus comprising:

a. a handle poriton having a first lengthwise axis;

b. a blade portion having a second lengthwise axis;

c. transmission means, adapted to be attached to said watercraft, for (i) coupling said handle portion to said blade portion in a manner that movement of said handle portion in a first longitudinal direction which is generally parallel to said longitudinal axis of said watercraft causes a corresponding movement of the blade portion in the first longitudinal direction, and movement of the handle portion in a second longitudinal direction which is generally opposite to said first longitudinal direction causes a corresponding movement of the blade portion in the second longitudinal direction, and (ii) for coupling said handle portion to said blade portion so that rotation of said handle portion about said first lengthwise axis causes a corresponding rotation of the blade portion about said second lengthwise axis, said transmission means including (1) a housing which is adapted to be connected to said watercraft, said housing including (i) an upper member, (ii) a lower member, (iii) upstanding support means which are connected between said upper and lower members, and (iv) an intermediate mounting member which is located between said upper member and said lower member and which is connected to said upstanding support means, (2) a first actuating member which is connected to the handle portion and which is pivotable about a first upright pivot axis during movement of the handle portion in the first and second longitudinal directions, said first actuating member mounted to said housing for pivotal movement about said first upright pivot axis, (3) a second actuating member which is connected to the blade portion and which is pivotal about a second upright pivot axis which is generally parallel to the first upright pivot axis, said second actuating member being mounted to said housing for pivotal movement about said second upright pivot axis, (4) first means for coupling said first actuating member to said second actuating member so that pivoting of said first actuating member about said first upright pivot axis in a first pivot direction causes pivoting of said second actuating member about said second upright pivot axis in a second pivot direction which is opposite to said first pivot direction, (5) second coupling means including (i) handle shaft means joined to said handle portion and rotatably engaged within said first actuating member, (ii) blade shaft means joined to said blade portion and rotatably engaged within said second actuating member, and (iii) third intermediate shaft means engaged between said handle shaft means and said blade shaft means in a manner that rotation of said handle shaft means about said first lengthwise axis is transmitted via said intermediate shaft means to cause a rotation of said blade shaft means which corresponds to said rotation of said handle shaft means, said intermediate shaft means supported within said intermediate mounting member at a location between siad first actuating member and said second actuating member.

2. The rowing apparatus as set forth in claim 1 wherein:

a. said upstanding support means includes first and second upstanding members;

b. said intermediate mounting member extends between said first and second upstanding members and c. said first and second actuating members are mounted to said housing between said first and second upstanding members.

3. The rowing apparatus as set forth in claim 2 wherein:

a. said first and second actuating members are connected to said housing in a manner that said first and second actuating members are adjacent to one another; and b. said first and second actuating members each include a top portion, and a bottom portion which is spaced apart from said top portion to form a cavity therebetween for receiving opposite ends of said intermediate shaft means therein in a manner to permit said pivotal movement of said first and second actuating members relative to said intermediate shaft means.

4. The rowing apparatus as set forth in claim 3 wherein:

a. said intermediate mounting member is spaced below said housing upper member and above said housing lower member to form respective upper and lower openings in said housing; and b. said first and second actuating members are connected to said housing in a manner that each of said top portions are located in said housing upper opening and each of said bottom portions are located in said lower opening to permit pivotal movement of said first and second actuating members.

5. The rowing apparatus as set forth in claim 4 wherein a. said first actuating member includes a first lengthwise pasageway within which said handle portion is rottably engaged in a manner to cause said pivotal movement of said first actuating member by said longitudinal movement of said handle member;

b. said first actuating member includes a first cavity in communication with said first passageway and which contains a first gear, a second gear, said intermediate shaft means and a first idler gear therein, said cavity sized in a manner to permit said first actuating member to pivot about said first upright pivot axis relative to said intermediate shaft means, said first and second gears, and said first idler gear; and c. said second actuating member includes a second cavity in communication with a second passageway and for receiving said intermediate shaft means and a third and fourth gears and a second idler gear therein, said second cavity sized in a manner to permit said second actuating member to pivot about said second upright pivot axis relative to said intermediate shaft means, said third and fourth gear members and said second idler gear member.

6. The rowing apparatus as set forth in claim 5 wherein:

a. said first cavity includes an inner surface which supports said first idler gear for rotation about said first upright pivot axis; and b. said second cavity includes an inner surface which supports said second idler gear for rotation about said second upright pivot axis.

7. The rowing apparatus as set forth in claim 1 wherein said transmission means includes:

a. first means for engaging said handle shaft means to said intermediate shaft means in a manner that rotation of said handle shaft means about said first axis, due to rotation of said handle portion a first selected amount in a first rotational direction, causes a rotation of said intermediate shaft means about a third axis; and b. second means for engaging said blade shaft means to said intermediate shaft means so that said rotation of said intermediate shaft means about said third lengthwise axis causes a rotastion of said blade shaft means about said second axis and a rotation of said blade portion therewith in said first direction and in an amount substantially equal to said first selected amount.

8. The rowing apparatus as set forth in claim 7 wherein:

a. said first engging means includes a first gear rigidly connected to said handle shaft means for rotation therewith about said first lengthwise axis, a second gear rigidly connected to said intermediate shaft means for rotation therewith about said third axis, and a first idler gear mounted for rotational movement about said first upright pivot axis in a manner that rotation of said handle shaft means in said first rotational direction by said first selected amount, causes rotation of said intermediate shaft means in a second rotational direction which is opposite to said first rotational direction and by a second amount substantially equal to said first selected amount; and b. said second engaging means includes a third gear ridigly connected to said intermediate shaft means for rotation therewith about said third axis, a fourth gear rigidly connected to said blade shaft means for rotation therewith about said second lengthwise axis, and a second idler gear mounted for rotation about said second upright pivot axis in a manner that said rotation of said intermediate shaft means in said second direction and by said second amount causes rotation of said blade shaft means and said blade portion therewith in said first direction by an amount substantially equal to said first amount.

9. The rowing apparatus as set forth in claim 8 wherein:

a. said first actuating member and said second actuating member have cylindrical outer surface configurations; and b. said first coupling means includes cable means which are connected about said outer surfaces of said first and second actuating members that pivotal movement of said first actuating member about said upright first pivot axis by a first pivotal amount causes a rotation of said second actuating member about said second upright pivot axis in a second pivotal direction which is opposite to said first pivotal direction and in an amount equal to said first pivotal amount.

10. The rowing apparatus as set forth in claim 9 wherein:

a. said first actuating member and said first idler gear are rotatably mounted about a first vertical shaft means which is connected to said housing and which has an axis which is coincident with said first upright pivot axis; and b. said second actuating member and said second idler gear are rotatably mounted about a second vertical shaft means which is connected to said housing and which has a longitudinal axis which is coincident with said second upright pivot axis.

* * * * *